US010327620B2

(12) United States Patent
Tyroler

(10) Patent No.: US 10,327,620 B2
(45) Date of Patent: Jun. 25, 2019

(54) SQUEEGEE

(71) Applicant: Dan Tyroler, Yesod Hamaala (IL)

(72) Inventor: Dan Tyroler, Yesod Hamaala (IL)

( * ) Notice: Subject to any disclaimer, the term of this patent is extended or adjusted under 35 U.S.C. 154(b) by 90 days.

(21) Appl. No.: 15/388,497

(22) Filed: Dec. 22, 2016

(65) Prior Publication Data

US 2017/0100012 A1 Apr. 13, 2017

Related U.S. Application Data

(63) Continuation-in-part of application No. PCT/IL2015/050651, filed on Jun. 24, 2015.

(30) Foreign Application Priority Data

Jun. 26, 2014 (IL) ..... 233429

(51) Int. Cl.
*A47L 13/11* (2006.01)

(52) U.S. Cl.
CPC ..... *A47L 13/11* (2013.01)

(58) Field of Classification Search
CPC ..... A47L 1/06; A47L 13/11; B60S 3/045
USPC ..... 15/117, 121, 245
See application file for complete search history.

(56) References Cited

U.S. PATENT DOCUMENTS

| | | | | | |
|---|---|---|---|---|---|
| 1,684,477 | A * | 9/1928 | Demand | A47L 1/06 | 101/120 |
| 2,109,606 | A | 3/1938 | Anderson | | |
| 2,155,462 | A * | 4/1939 | Anderson | A47L 1/06 | 15/105 |
| 2,864,115 | A | 12/1958 | Champlin | | |
| 3,484,888 | A | 12/1969 | Davis | | |
| 3,766,591 | A * | 10/1973 | Soito | A47L 13/11 | 15/244.1 |
| 4,342,128 | A * | 8/1982 | Doyle | G02C 11/08 | 15/245 |
| 4,607,411 | A * | 8/1986 | Lewis, Jr. | A46B 17/08 | 15/117 |
| 7,028,367 | B2 | 4/2006 | Sharabura et al. | | |
| 7,703,167 | B2 | 4/2010 | Sharabura et al. | | |
| 8,375,503 | B2 | 2/2013 | Aznag | | |
| 2002/0032945 | A1 | 3/2002 | Miyamoto | | |
| 2002/0100135 | A1 | 8/2002 | Machevsky | | |

(Continued)

FOREIGN PATENT DOCUMENTS

| | | | |
|---|---|---|---|
| EP | 811349 | * | 12/1997 |
| EP | 2777466 | * | 9/2014 |

(Continued)

OTHER PUBLICATIONS

ISRWO dated Oct. 15, 2015 issued in corresponding International Application No. PCT/IL2015/050651.

*Primary Examiner* — Mark Spisich
(74) *Attorney, Agent, or Firm* — Onello & Mello, LLP

(57) ABSTRACT

A squeegee including an elongated squeegee blade having a substantially rigid upper portion and a lower flexible wiper portion. The squeegee further includes a generally T-shaped extension centered above and axially parallel with the squeegee blade. The T-shaped extension has a substantially rigid flange, operably connectable to the squeegee handle; and a flexible leg extending downward from the rigid flange and connected there-below to the rigid upper portion of the squeegee blade.

13 Claims, 5 Drawing Sheets

(56) References Cited

U.S. PATENT DOCUMENTS

| | | | |
|---|---|---|---|
| 2010/0180395 | A1 | 7/2010 | Aznag |
| 2011/0107551 | A1 | 5/2011 | Cassar |

FOREIGN PATENT DOCUMENTS

| | | | |
|---|---|---|---|
| GB | 450830 | * | 7/1936 |
| GB | 2432109 | | 5/2007 |
| IL | 119568 | | 8/2002 |
| JP | 0659543 | | 8/1994 |
| JP | 8-104203 | * | 4/1996 |
| JP | 8-117155 | * | 5/1996 |
| JP | 8-117156 | * | 5/1996 |
| JP | 2014139050 | | 7/2014 |
| KR | 20100053611 | | 5/2010 |
| KR | 20120045368 | | 5/2012 |
| WO | 2015198324 | | 12/2015 |

* cited by examiner

SQUEEGEE

REFERENCE TO RELATED APPLICATIONS

This application is a Continuation-in-Part application of PCT/IL2015/050651, entitled "Squeegee", filed on 24 Jun. 2015, and which claims priority from IL 233429, entitled "Squeegee", filed on 26 Jun. 2014, the content of each being incorporated herein by reference, in its entirety.

FIELD OF THE INVENTION

The present invention relates to wiping mechanisms, in particular squeegees for wiping floors and other flat surfaces.

BACKGROUND OF THE INVENTION

Wiper blades for moving water on flat surfaces such as floors are commonly used in Israel and North West Africa. In other places in the world squeegee wiper blades are used mostly in industrial and institutional premises where there are large quantities of water.

The method of working with a wiper blade on a stick or handle is as follows:

1. Pushing the water

The user walks forward and pushes the squeegee with the stick or handle away from him moving the water forward. This method is suitable for industrial applications with large quantities of water.

2. Collecting the water

The user draws the squeegee with the stick or handle towards him pulling the water towards him.

Most conventional flat wiper blades are flat rubber blades contained in a track and fastened thereto with screws or attached under pressure or by threading therein, etc. A handle or stick is attached to the track. Such wiper blades become warped and break down quickly.

Squeegees made of a single piece rubber, not requiring a track are also widely used. These squeegees are made of synthetic or natural rubber, are hard and tough on one side with flexible blades on the other side. The combination of these two properties makes their performance better than the conventional squeegees and gives an exceptionally long life expectancy. Such squeegees are described in Israel patent IL119568.

U.S. 2011/107,551 (Cassar) describes a squeegee of broom attachment that provides lateral flexibility between the handle and the squeegee blade (or broom bristles) via symmetrical open-ended recess cavities, thereby providing left/right bending of the attachment with respect to the squeegee.

One problem with collecting water using presently available squeegees is as follows:

Starting Position:

When a user uses a squeegee to collect water, he/she usually starts with holding out the squeegee a meter or more away from the body. In such a position, the squeegee is at an angle of about 40° with the floor. This is an optimal, or at least, preferred angle, in which the squeegee collects water effectively and leaves the floor relatively dry there-behind, and there is no need to put significant pressure on the wiper blade.

Intermediate Position:

The user brings the water towards him/her over a distance of 50 cm from the body. In these 50 cm, the angle of the squeegee to the floor is changed from about 40° to 65° as the squeegee gets closer to the user. This range between 40° and 65° is the range in which the squeegee still collects water/liquid well and the user still does not have to put significant pressure on the wiper blade.

Last Collecting Stage:

The user further pulls the squeegee towards him/her, getting relatively close to the user's body. In this stage of collection, the angle of the squeegee with the floor fluctuates from about 65° to 90° . In the range of these angles, the squeegee is not efficient because the end of the blade is very thin providing a very small contact area with the floor surface. Therefore, the user needs to exert more pressure on the squeegee, so that the blade of the squeegee will change its angle to the floor to a sharper angle ranging from 40° to 65°.

With squeegees for floors available nowadays, the change of angle of the wiper blade to the floor is carried out by exerting pressure and bending (arching) the blade. Since the exerted pressure is not uniform along the entire length of the blade, but rather greater on the center section of the wiper blade underneath the stick, the blade does not bend uniformly, and more bending/arching occurs in the center section of the blade. The arched section of the blade is highly tensioned, and this may even cause the wiper blade to shake while in use, i.e., while pulling/pushing water which makes it harder for the user to control the blade.

There are also window or windshield wipers of numerous types that have been developed over the years for various applications some of which are described below:

GB2432109 describes a wiper blade for removing water from a surface including a plurality of wiper blade segments that ensure optimum contact with the surface being cleaned. The wiper blade may be operated by hand, as a squeegee, or by mechanical means, for example in windscreen wipers of a vehicle.

U.S. Pat. No. 2,109,606 discloses a cleaning device which is durable, efficient and convenient to handle. This is a cleaning device that may be employed for cleaning small and inaccessible surfaces.

U.S. Pat. No. 7,028,367 describes a wiper blade made of methyl vinyl silicone polymer, a filler and a friction-reducing additive.

U.S.2002/032,945 discloses an elongated rubber wiper blade that includes a base portion fixed to the wiper blade, a neck portion, and three lip portions in which a central lip is suspended from the base portion through the neck portion at a central portion of the underside of the base portion, while lateral lips branch off from the central lip on lateral sides thereof.

It should be noted that some of the windscreen wipers for cars described above have a specially configured top portion over a base section along the entire length of the base for inserting into a track.

SUMMARY OF THE INVENTION

In accordance with embodiments of one aspect of the present invention there is provided an improved squeegee for use in combination with a squeegee handle to which the squeegee is operably connectable. The squeegee includes an elongated squeegee blade having a substantially rigid upper portion and a lower flexible wiper. The squeegee further includes a generally T-shaped extension centered above the squeegee blade. The T-shaped extension includes a substantially rigid flange, operably connectable to the squeegee handle; and a flexible leg extending downward from the rigid flange and connected there-below to the rigid upper portion of the squeegee blade. Upon using the squeegee, a wiping force on the squeegee flexes the flexible leg and thereby produces a non-aligned state between the squeegee handle and the flexible wiper—i.e. the handle and the blade form an angle with a vertex at the flexible leg.

The entire squeegee may be manufactured as a one-piece unit.

It is a particular feature of the present invention that the flexible leg of the substantially T-shaped extension provides flexibility whereby, upon wiping with the squeegee, the wiping force exerted by the user (via the handle) results in flexing of the flexible leg. This flex of the leg produces a non-aligned orientation between the handle and the blade; i.e. an angle between the handle and the blade. This angle facilitates the blade of the blade to be maintained at preferred angles with the floor for improved wiping efficiency. For understanding only, and not intended to limit scope, it is noted that typically the preferred angle of the wiper blade to the floor is about 40 to 45 degrees.

In some embodiments, the squeegee is made of a material selected from natural or synthetic rubber, silicone, polymers or a mixture thereof.

In some embodiments, the upper portion of the wiper blade is reinforced to provide rigidity, such as by a reinforcement rod disposed therein (herein the specification and claims the term "rod" will denote any suitable reinforcement member including a bar, a plate, wire(s), fibers and the like). In some embodiments, the rod extends essentially throughout the entire length of the upper portion of the blade. In some embodiments, the rod is made of a rigid material selected from metals, alloys, polymers and the like.

In some embodiments, the wiper blade and T-shaped extension are molded as a single piece.

In some embodiments, the top surface of the T-shaped extension comprises means for attaching a handle socket.

In some embodiments, the socket is mounted on the T-shaped extension.

In some embodiments, the socket is manufactured as a single unit.

In some embodiments, the T-shaped extension is between ½ and ⅙ the length of the wiper blade.

In some embodiments, the flange of the T-shaped extension is reinforced to provide rigidity.

In some embodiments, the flange of the T-shaped extension is reinforced via a reinforcement bar disposed therein (herein the specification and claims the term "bar" will denote any suitable reinforcement member including a rod, a plate, wire(s), fibers and the like).

In some embodiments, the bar extends substantially throughout the entire length of the rigid flange of the T-shaped extension.

In some embodiments of another aspect of the invention, there is provided a method of manufacturing a one piece squeegee made of rubbery material by molding with reinforcements in a single operation.

It is an object of the present invention to provide an improved squeegee for the collection of water from flat surfaces that is operated with a typical handle and which facilitates efficient wiping as well as drying of the flat surfaces with minimum effort, i.e., by collecting the water (drawing the water towards oneself) with minimum application of pressure on the squeegee.

During use, when the user presses lightly on the squeegee, the angle of the squeegee blade changes to or continues at a more preferable angle with the floor of about 40° to 45°. The angle changes linearly with the pressure applied. As a result, because the flexible leg relatively easily bends, the wiper is not significantly arched, rather tends to remain fairly straight.

DETAILED DESCRIPTION OF EMBODIMENTS

The following detailed description of embodiments of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts. Illustrative embodiments of the invention are described below. In the interest of clarity, not all features/components of an actual implementation are necessarily described.

Figure 1:
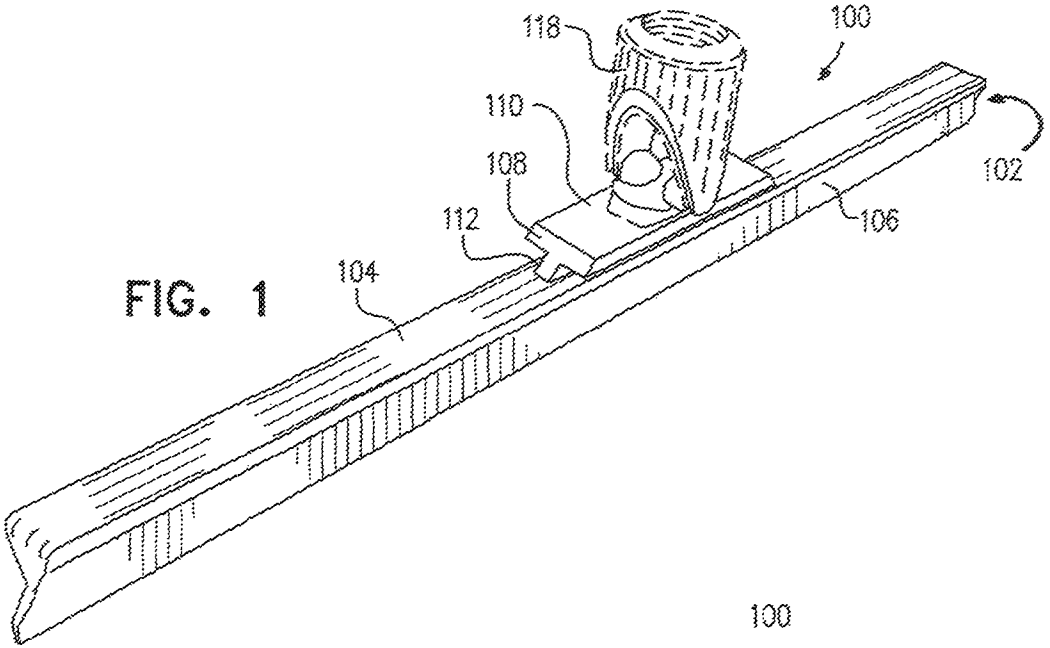
FIG. 1 is a perspective view illustrating an embodiment of a squeegee in accordance with the present invention.
Figure 2:
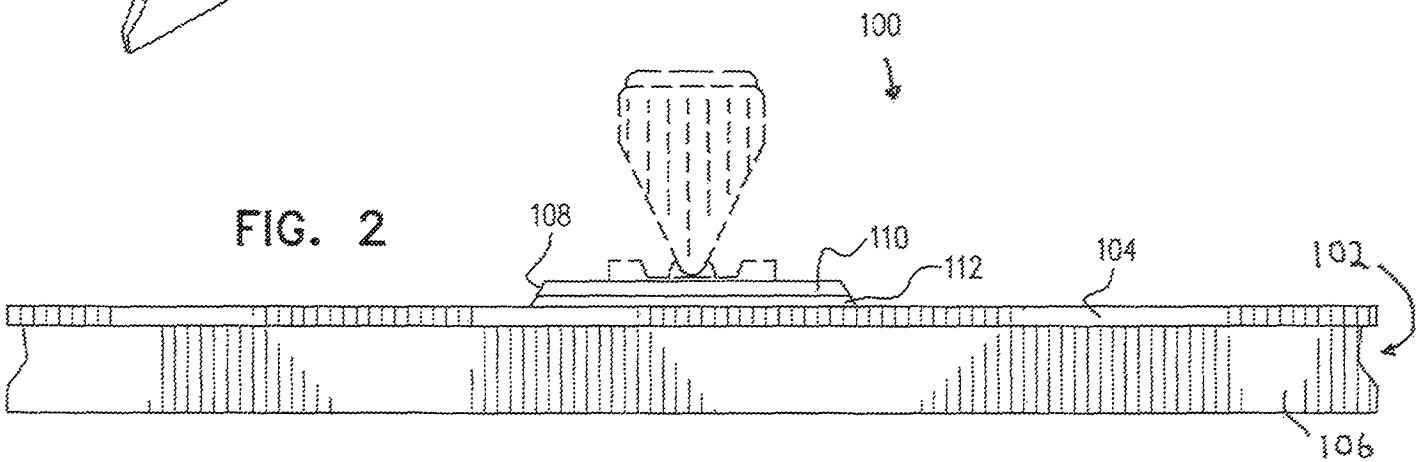
FIG. 2 is a front view of the squeegee of FIG. 1.

FIGS. 1 and 2 illustrate a squeegee 100 in accordance with embodiments of the present invention. The squeegee 100 has an elongated squeegee blade 102, in some embodiments made in one piece from natural or synthetic rubber or silicone, polymers or a mixture thereof by molding. Squeegee blade 102 includes a rigid upper blade portion 104, a flexible wiper 106, and a T-shaped extension 108 having a horizontal, substantially rigid flange 110 and a flexible leg 112.

Figure 6A:
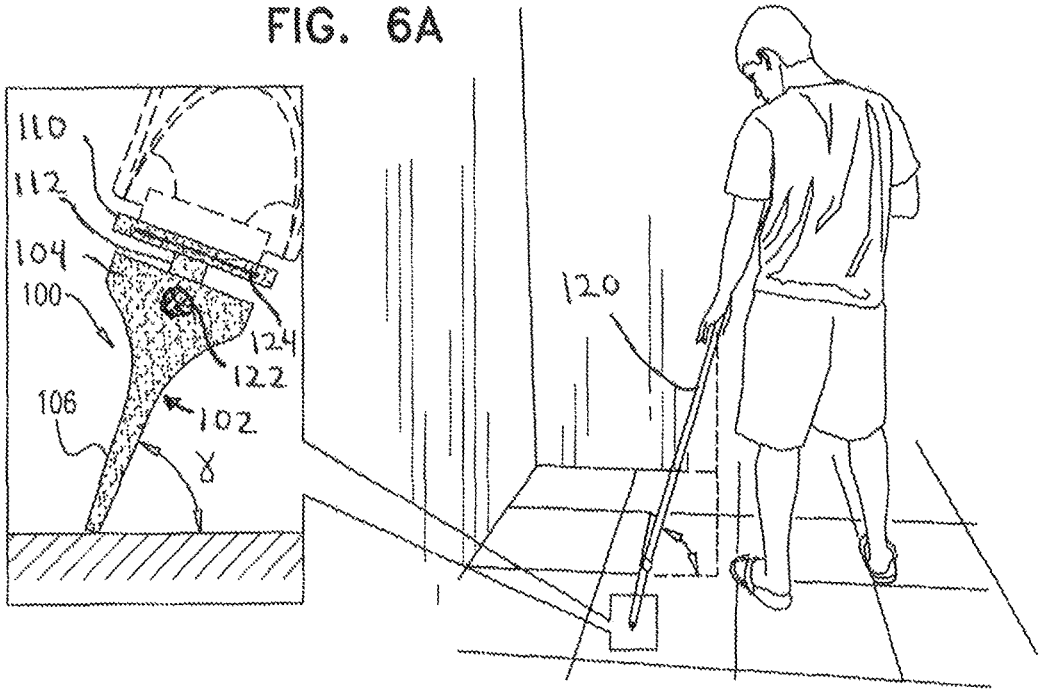
FIG. 6A illustrates the squeegee of the present invention held by a user close to his body.
Figure 6B:
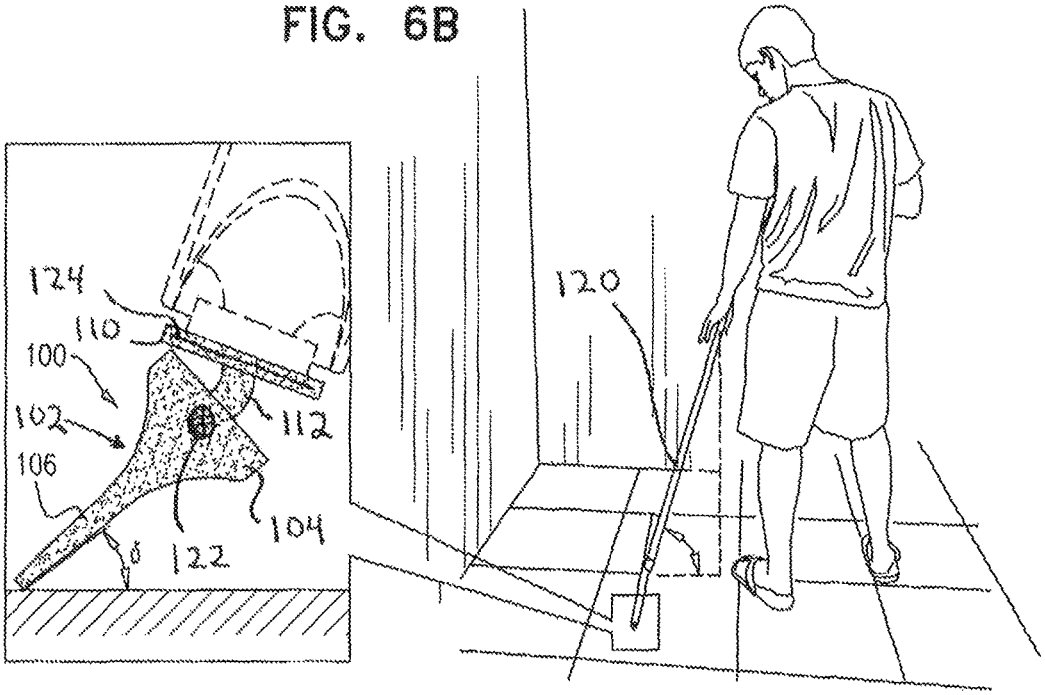
FIG. 6B illustrates the squeegee of the present invention held and pressed very lightly by the user.

Flange 110 may include threaded grooves for attachment to a socket 118 that holds a stick or handle 120 (see FIGS. 6A-B). The socket 118 can be a fixed socket or a swivel socket that can be locked in position, as is known in the art.

T-shaped extension 108 extends from the surface of rigid upper blade portion 104 of squeegee blade 102 and is typically centered and about ½ to ⅙ the length of the blade.

The rigid upper blade portion 104 is typically reinforced internally by a plate or rod 122, which preferably extends essentially or substantially the entire length of the rigid upper blade portion 104 of blade 102. The rod 122 may be made of metal, polymers and the like.

Similarly, flange 110 of the T-shaped extension 108 preferably has an internal reinforcing rod or plate 124, which may be made of metal, polymers and the like.

The inner reinforcement rod 122 of rigid upper blade portion 104 and the flange 110 provides the squeegee with stiffness while leg 112 gives the squeegee flexibility, enabling blade 102 and its wiper 106 to be operated with minimum effort.

In some preferred embodiments, extension 108 is shorter than squeegee blade 102, whereby leg 112 is relatively short, thereby aiding in its flexibility while allowing the leg to still be thick enough to withstand wear and tear. In some embodiments, the length of the T-shaped extension 108 is between ½ and ⅙ the length of blade 102.

Figure 3:
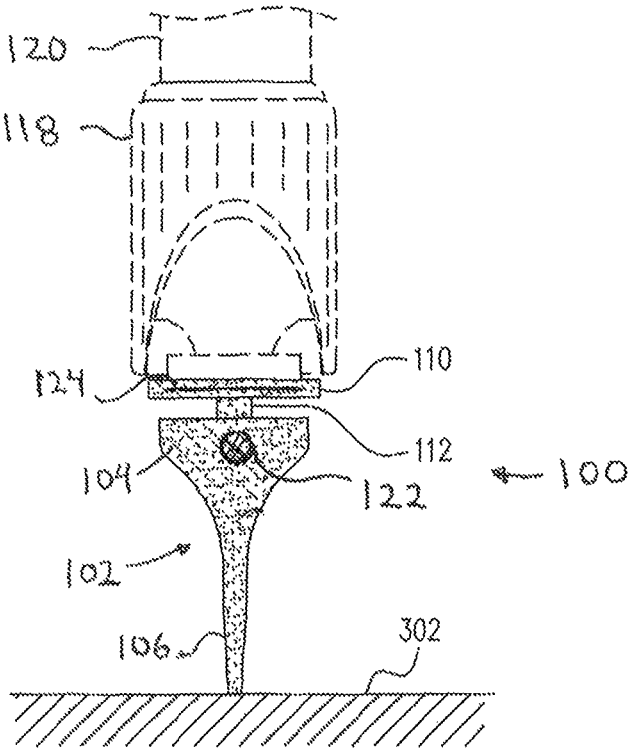
FIG. 3 is a cross-sectional view of the squeegee of FIG. 2.

As seen in FIG. 3, squeegee blade 102 may taper from the bottom of rigid upper blade portion 104 toward a thin elongated free end of wiper 106.

Figure 4:
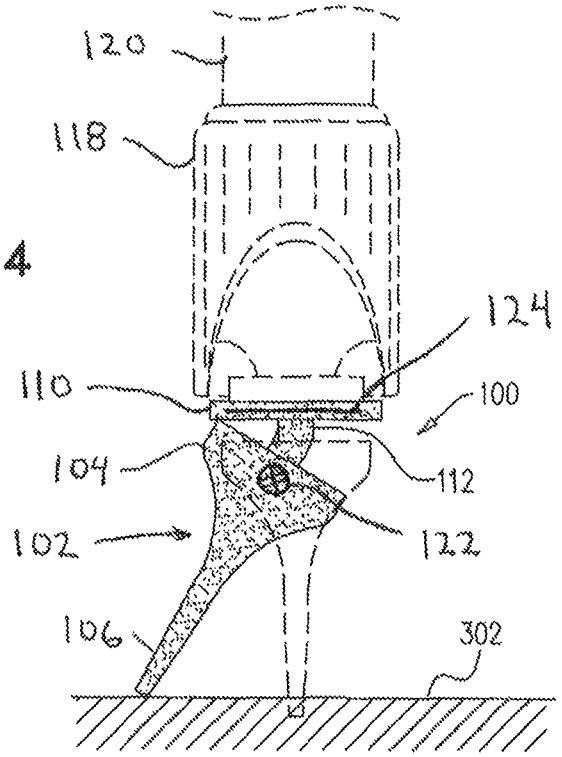
FIG. 4 is a view as in FIG. 3 with the squeegee blade tilted.

FIG. 4 shows squeegee blade 102 in a tilted orientation where handle 120 is not aligned therewith, nor with flexible wiper 106, rather an angle is formed between handle 120 and blade 102, due to flexing of leg 112. Leg 112 is typically relatively thin compared to rigid upper blade portion 104 of squeegee blade 102 thereby facilitating the squeegee blade to be angled with respect to the floor 302 so that the blade, and especially flexible wiper 106, engages a larger surface to be wiped. This is important, as otherwise, when squeegee 100 is drawn towards the user, the angle of blade 102 with the floor 302 would typically be greater than the preferred 40 to 45 degree angle, e.g. typically at an angle of about 65 degrees. However, when the user presses very lightly, thin leg 112 permits the angle of the blade 102 and flexible wiper 106 to more or less remain at a preferred angle of about 40°-45° with the floor 302, due to the continued, and typically increasing (during operation), flexing of leg 112.

Figure 5A:
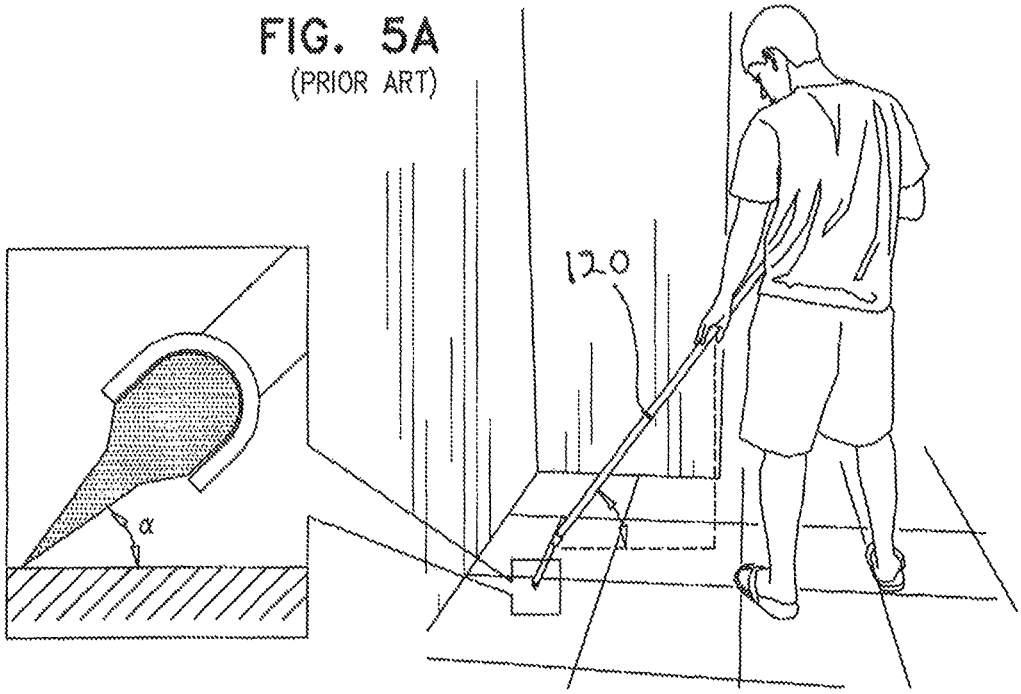
FIG. 5A (PRIOR ART)
FIG. 5A (PRIOR-ART) illustrates a squeegee available nowadays held by a user away from his body.

FIG. 5A (PRIOR-ART) illustrates a squeegee available nowadays held by a user away from his body. As seen in the figure, the user holds the squeegee away from his body, and the blade is at an angle, $\alpha$, relative to the floor, which is about 40°.

Figure 5B:
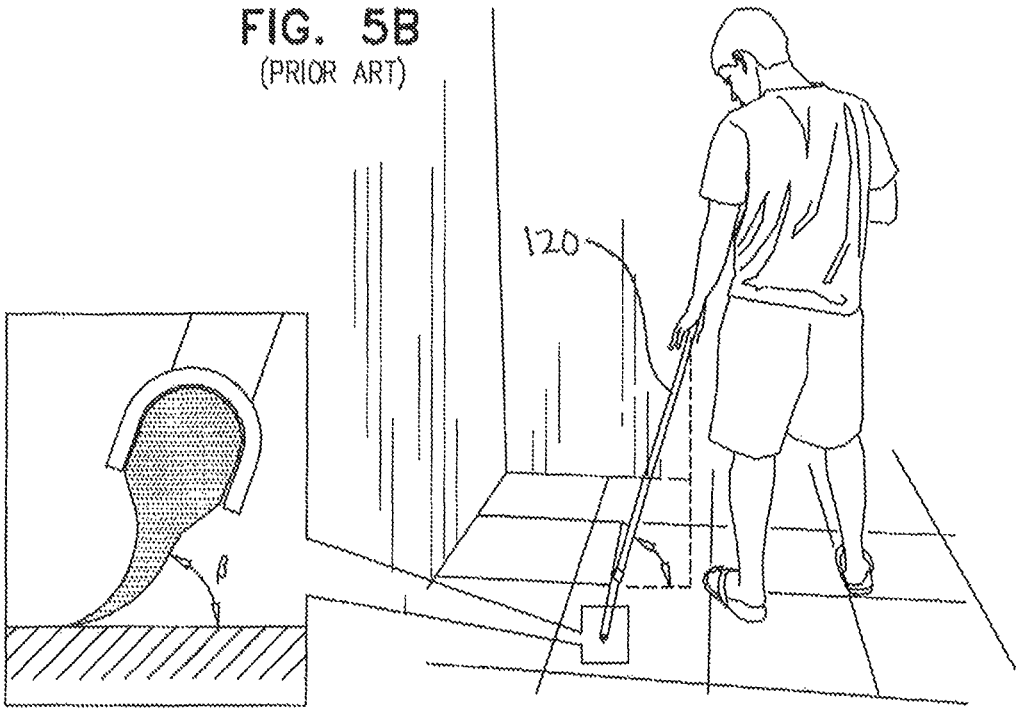
FIG. 5B (PRIOR ART)
FIG. 5B (PRIOR-ART) illustrates a squeegee available nowadays held by a user close to his body.

FIG. 5B (PRIOR-ART) illustrates a squeegee available nowadays held by a user close to his body. When the user brings the squeegee closer to his body, as shown, the blade bends relative to the floor, to an angle, $\beta$, which is about 65°.

FIG. 6A illustrates the squeegee 100 of the present invention held by a user close to his body, and FIG. 6B illustrates the squeegee 100 pressed lightly by the user. As seen in FIG. 6A, the angle of approach of squeegee blade 102 with the floor, $\gamma$, is greater than 65°.

However, during use (FIG. 6B), when the squeegee 100 is brought closer to the user, even without applying significant pressure on the squeegee, leg 112 flexes so that there is an angle of approach of the squeegee with the floor, angle $\gamma$, of about 40° or so, which is less than 65°, and is a more preferred angle for wiping the floor.

Figure 7:
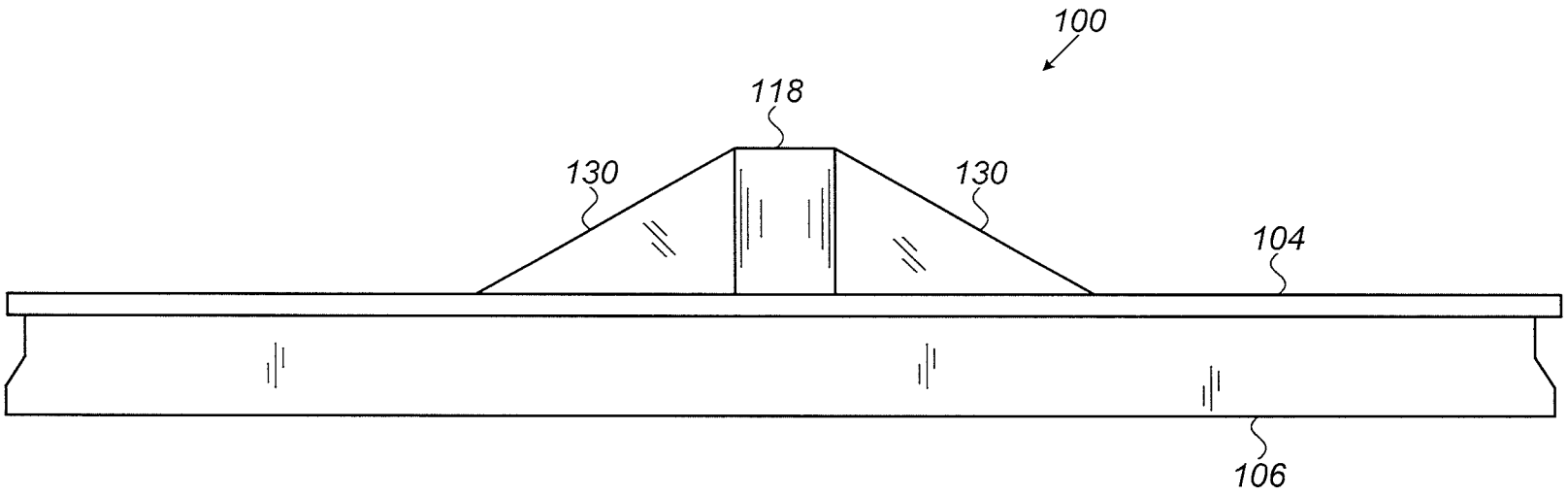
FIG. 7 is a front view of another embodiment of the squeegee.

FIG. 7 shows another embodiment of squeegee 100 wherein the blade 102; upper blade portion 104, including wiper 106; T-shaped extension 108; flange 110; flexible leg 112; and handle socket 118 are constituted by a one-piece unit (i.e. integrally formed), typically of rubber or other elastomeric material, optionally, with suitable internal reinforcement. In some embodiments and as illustrated, squeegee 100 includes a pair of reinforcement wings 130, each wing attached to and flanking the handle socket 118 as well as attached to a portion of upper blade portion 104 so as to span and connect between the socket and the upper blade portion. Reinforcement wings 130 provide strength to the unit and limit right/left flexing.

The invention claimed is:

1. A squeegee for use in combination with a squeegee handle to which the squeegee is operably connectable, the squeegee comprising:

an elongated squeegee blade having:

a substantially rigid upper portion, and a lower flexible wiper;

wherein the squeegee further comprises a generally T-shaped extension centered above the squeegee blade, the T-shaped extension comprising:

a substantially rigid flange operably connectable to the squeegee handle; and a flexible leg extending downward from the rigid flange and connected there-below to the rigid upper portion of the squeegee blade, the T-shaped extension being between ½ and ⅙ the length of the wiper, whereby upon using the squeegee, a wiping force on the squeegee flexes the flexible leg and thereby produces a non-aligned state between the squeegee handle and the flexible wiper.

2. The squeegee of claim 1, made of a material selected from natural or synthetic rubber, silicone, polymers or a mixture thereof.

3. The squeegee of claim 1, wherein the rigid upper portion of the squeegee blade is reinforced to provide rigidity.

4. The squeegee of claim 3, wherein the rigid upper portion of the squeegee blade is reinforced via a rod disposed therein.

5. The squeegee of claim 1, wherein a plate extends substantially throughout the entire length of the flange of the T-shaped extension.

6. The squeegee of claim 1, wherein the squeegee blade and T-shaped extension are molded as a single piece.

7. The squeegee of claim 1, wherein the T-shaped extension comprises means for attaching a handle socket thereto.

8. The squeegee of claim 7, wherein the socket is mounted on the T-shaped extension.

9. The squeegee of claim 1, wherein the flange of the T-shaped extension is reinforced to provide rigidity.

10. The squeegee of claim 1, wherein the flange of the T-shaped extension is reinforced via a reinforcement bar disposed there-within.

11. A method of manufacturing a squeegee as in claim 1 comprising forming the squeegee in one piece of a rubbery material by molding the squeegee, including the squeegee blade and the T-shaped extension, with reinforcements, in a single operation.

12. The squeegee of claim 1, wherein the squeegee is attachable to a squeegee handle via a squeegee handle socket and said socket and squeegee are integrally formed in a one piece unit.

13. The squeegee of claim 12, wherein said one piece unit includes a pair of reinforcement wings, each wing attached to and flanking the handle socket and attached to a portion of the rigid upper portion.

* * * * *